US006634297B2

(12) United States Patent
Poetter et al.

(10) Patent No.: US 6,634,297 B2
(45) Date of Patent: Oct. 21, 2003

(54) DEVICE AND PROCESS FOR SETTING THE PRINTED IMAGE IN A FLEXOGRAPHIC PRESS

(75) Inventors: Dietmar Poetter, Westerkappeln (DE); Martin Kruempelmann, Lengerich (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 10/106,808

(22) Filed: Mar. 27, 2002

(65) Prior Publication Data

US 2003/0005840 A1 Jan. 9, 2003

(30) Foreign Application Priority Data

Mar. 27, 2001 (DE) ..... 101 15 134
Sep. 18, 2001 (DE) ..... 101 45 957

(51) Int. Cl.[7] ..... B41F 1/54; B41F 31/02

(52) U.S. Cl. ..... 101/484; 101/211; 101/181; 101/348; 101/DIG. 45

(58) Field of Search ..... 101/483, 484, 101/486, 181, 211, 248, 365, DIG. 45, 348, 349.1

(56) References Cited

U.S. PATENT DOCUMENTS 4,553,478 A * 11/1985 Greiner et al. ..... 101/181
5,689,425 A * 11/1997 Sainio et al. ..... 101/181
5,724,259 A * 3/1998 Seymour et al. ..... 101/211
5,841,955 A * 11/1998 Wang ..... 101/365
5,967,050 A * 10/1999 Seymour ..... 101/484
5,992,318 A * 11/1999 DiBello et al. ..... 101/181
6,085,658 A * 7/2000 Goldstein ..... 101/486
6,142,078 A * 11/2000 Lachajewski ..... 101/211
6,167,806 B1 * 1/2001 Chretinat et al. ..... 101/483
6,318,260 B1 * 11/2001 Chu et al. ..... 101/365

FOREIGN PATENT DOCUMENTS

DE 29 41 521 4/1981
DE 37 42 129 6/1989
DE 40 01 735 7/1991

* cited by examiner

*Primary Examiner*—Eugene H. Eickholt
(74) *Attorney, Agent, or Firm*—Jacobson Holman PLLC

(57) ABSTRACT

Introduced are a device and a process for setting the printed image of a rotary press by adjusting the relative position of the rollers (3, 7, 8) involved in the ink transfer.

In this respect at least one part of these rollers (7, 8) can be moved toward each other both together and also independently of each other by means of their own actuating drives (M1 to M4), so that the rollers (3, 7, 8) involved in the printing process can be set into motion in relation to each other, In addition, there is at least one camera (K) that scans the printed image (10) on the printed material web (17) and that feeds the images shot in succession to an electronic control and regulating unit (13).

This control and regulating unit (13) generates signals for the actuating drives of at least one part of the rollers (3, 7, 8) involved in the printing and inking process until or as the printed image is reproduced without area loss.

17 Claims, 3 Drawing Sheets

DEVICE AND PROCESS FOR SETTING THE PRINTED IMAGE IN A FLEXOGRAPHIC PRESS

The invention relates to a device and a process in accordance with the preamble of claim 1.

In this respect it must be remembered that it is necessary to set the printed image by optimizing the relative position of the rollers, involved in the inking and printing process, in all areas of rotary printing. Thus, in the case of gravure printing presses the position of the impression roller is set in relation to the printing roller.

In the case of flexographic presses the counter-impression cylinder, the printing roller and the engraved roller are set in relation to each other.

Therefore, there exist flexographic presses that are equipped with a printing roller and an engraved roller that can be moved on at least one bracket of the printing machine frame. These two rollers can be employed by means of their own actuating drive both independently of each other as well as together at the counter-impression cylinder, on which the material web to be printed rests.

Thus, the DE 29 41 521 A1 and DE 37 42 129 A1 show printing machines, in which the bearing blocks of the carriages carrying the printing cylinders are guided in carriage guides of the inking system brackets of the printing machine frame and are provided with their own spindle drives and in which the carriages of the printing cylinders are provided with other carriage guides for the carriages, which carry the bearing blocks of the inking or engraved rollers and which exhibit in turn their own spindle drives.

The DE 40 01 735 A1 discloses a flexographic press, in which the carriages, carrying the printing roller, and the carriages, carrying the inking or engraved rollers, are guided in a common carriage guide of the ink system brackets of the printing machine and are moved jointly and individually by means of spindle drives.

In the case of rotary presses of this known type, the printed image is set in the known way as follows. An electronic controller is provided that can resort to data entered into a storage device. The data relate to the regulating distance between the printing roller and the counter-impression roller in consideration of the geometric dimensions of the machine and the diameter of the rollers. Then this controller adjusts the relative roller position so that it should be guaranteed that all parts of the printed image are transferred.

Of course, the different rollers, printing forms, as well as the material to be printed and all other parts involved exhibit geometric tolerances so that an additional adjustment is often necessary.

This additional adjustment is executed by means of a press guide who adjusts the roller positions while viewing the printed image.

This type of adjustment of the printed image guarantees that with the minimum pressure applied to the rollers involved in the printing process a good printed image is obtained. This type of adjustment of the printed image is, however, complicated, requires a lot of time and rejects and has, furthermore, the drawback that it depends on the subjective judgment of the press guide using visual inspection.

Therefore, the object of the invention is to provide a device of the aforementioned class that makes it possible to set automatically the printed image to the desired optimal quality.

The invention solves this problem with a device of the aforementioned class by providing at least one camera that scans the printed image on the material web being printed and that feeds images shot in succession to an electronic controller. This controller determines the optimal roller positions from the images that were taken and thus drives automatically the positioning motors.

In this respect it is advantageous to provide a control program that knows the geometric dimensions of the rollers involved in the printing and inking process and that may or may not set tentatively (for example, in the case of long regulating distances or after a roller change) the position of these rollers relative to each other by means of signals to the actuating drives.

However, the inventive process also functions when there is no additional control program.

An advantageous embodiment of the invention provides that the digitized desired contour of the printed image is deposited in the storage unit. This desired contour is then compared (optionally in the controller) with the respective printed image that is shot. Then the controller generates actuating signals for the actuating drives moving the rollers until the comparison yields the best agreement between the printed image that is shot and the stored desired contour.

Another embodiment of the invention does not require a digitized desired contour deposited in a storage. This additional embodiment exploits the fact that the intensity of the reflected light of different segments of the printed image exhibits a characteristic curve as a function of the relative roller position.

Thus, the intensity of the reflected light does not change as long as there is no contact between all of the rollers involved in the printing and inking process. When contact is made, the ink transfer to the material to be printed begins; and the intensity of the reflected light changes quite significantly until the ink transfer reaches an optimal value. As the rollers continue to approach each other, the intensity of the reflected light changes only slightly.

In the area, in which the change in intensity flattens off, an optimum between the ink transfer process and the pressure applied to the rollers to set them in motion in relation to each other is usually reached. If the rollers were to continue to approach each other, the only pressure that would build up would result in the rollers, roller bearings, printing forms, material to be printed, etc. being damaged.

For this reason it is advantageous to section the printed image that is shot into different segments, and to take immediately a picture with a camera that shoots a plurality of image segments.

During the evaluation of the image segments the aforementioned curve of the light intensity is plotted for the individual image segments.

Not until an adequate number of image segments exhibit a certain selected intensity curve is the mutual head-on approach of the rollers terminated. For high requirements posed on the print quality, this requirement will have been met when the change in the intensity of all of the image segments regresses or has already regressed. Thus, it is guaranteed that a good ink transfer to all segments of the printed image takes places.

This embodiment can be improved by forming the difference between the intensity values of the printed material and the intensity values of the non-printed material to be printed. The differentials obtained are called below the contrast values. They can be used in a manner analogous to the intensity values.

The use of at least one color camera is recommended as another advantageous measure, so that light of the selected wavelength ranges can be plotted. This measure is suitable for facilitating the comparison with the stored digitized desired contour of the printed image as well as for improving the curve of the light intensity or the contrast values. Commercial cameras of modern design usually exhibit as the light sensitive elements semiconductor components that are sensitive to light of specific wavelengths, a feature that stems from the photo effect and its application in the semiconductor area. It is advantageous, when a camera is able to assign in this way electrical output values to the color intensity values of several colors (for example, red, yellow, blue). Then these values are made available to a regulating and control unit.

In this way the color intensity curve of different colors or even the entire spectrum of a printed image or even the segments of a printed image can be plotted. Then the measured values are used in the manner described above in order to set the suitable position of the printing rollers. Even for the individual colors a contrast can be formed by the method described above.

Light intensity values can also be transferred into coordinate systems that are appropriate for further evaluation. The same also applies, of course, to the contrast values. These values, derived in the last instance from the intensity values and the color values (wavelength/frequency), also exhibit a characteristic curve as a function of the relative position of the rollers and can be used in the manner described above.

Especially advantageous is the use of the inventive process in flexographic printing, since here the thickness of the blocks must be taken into consideration. In addition, their adhesive strips and the other elements that are involved can exhibit different thickness tolerances so that it can happen that when the parts are set gently into motion so that they just touch, not all of the parts of the blocks produce printed images, thus resulting in only partial images. Therefore, the deviation between the aforementioned geometric desired value and the actual positions of the rollers involved in the printing process is especially large in the case of flexographic printing.

Expediently a digital camera is used as the camera. It delivers digitized images of the printed images that were shot.

In the case of multiple print units each print unit can be set separately.

Furthermore, a separate setting of the actuating drives can be provided in order to make the various rollers parallel, should the pressure differ over the length of a roller on account of its inclined position. In flexographic printing one would provide, for example, for the capability of setting separately the actuating drives of one side of the ink system (s) in order to guarantee, among other things, that the printing and counter-impression cylinder are parallel.

A measurement procedure within the scope of this application is the observation of the course of the intensity and/or contrast values, during which the rollers involved in the printing process are adjusted in relation to each other. If only one camera is used, there is the possibility of adjusting sequentially several inking systems of a machine, that is, of carrying out a measurement process while setting an inking system.

However, it is also possible to carry out only one measurement process at the material to be printed, which has already passed through several inking systems, while adjusting these inking systems of a machine. This procedure results in an additional saving of time. Optionally this procedure is also possible when only one camera is used.

As soon as the setting(s) that yields/yield the best agreement between the printed images that are shot and the desired contour has/have been reached, the values can be deposited in a storage. The same also applies naturally to those set values that are derived from the other setting procedures, according to the invention.

In this way these set values can be found quickly again, for example, after a printing process has been interrupted and after the printing cylinder has been moved away.

Embodiments of the invention are explained below with reference to the drawings.

FIG. 1 is a schematic drawing of a flexographic press with only one print unit, wherein one electronic controller makes it possible to regulate the printing roller; and FIGS. 2A to C is a schematic drawing of the order of sequence of setting the engraved roller and the printing roller of a flexographic press in motion relative to each other and their joint employment at the counter-impression cylinder.

Figure 1:
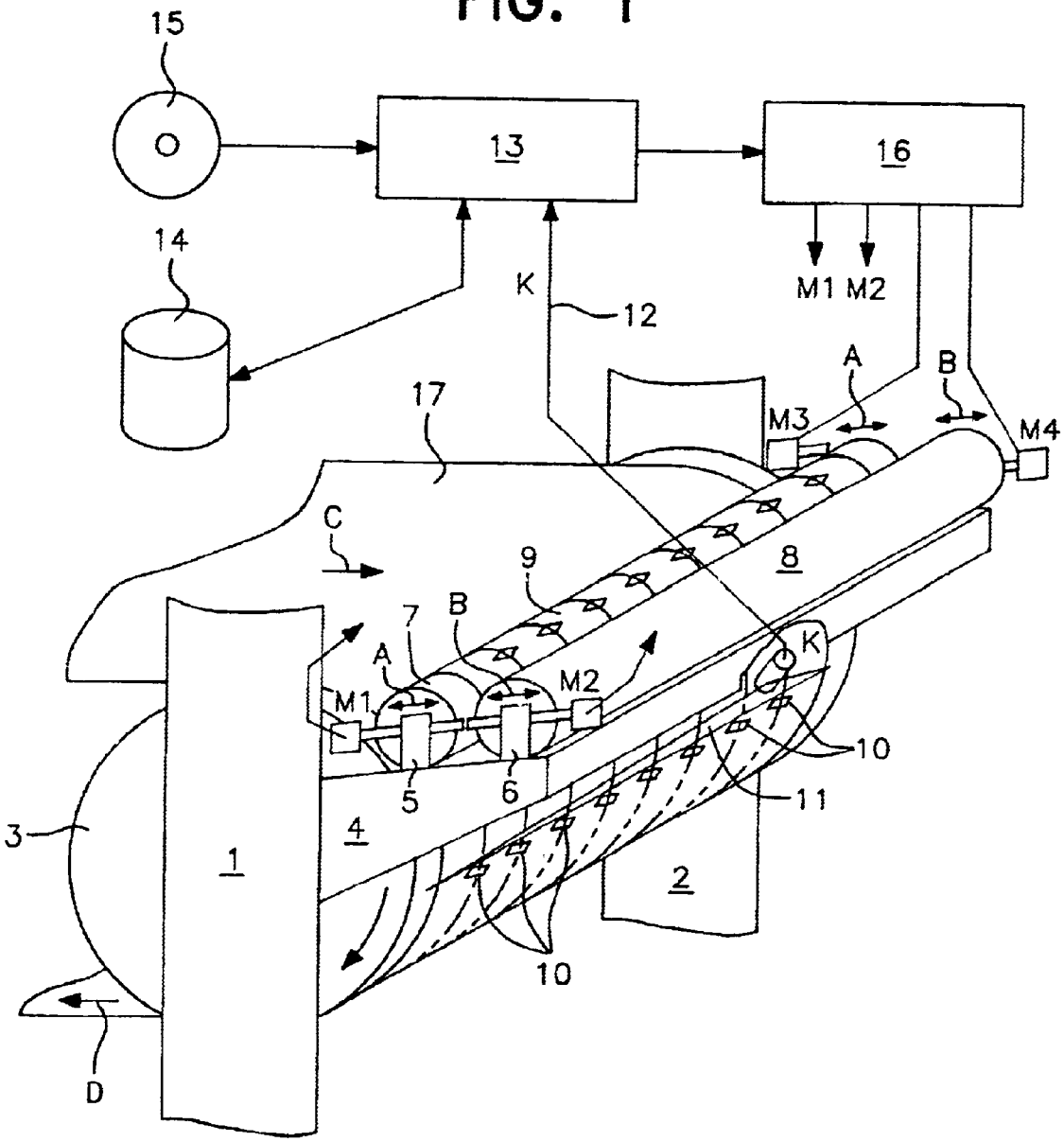

In a printing machine frame, of which only the side members 1 and 2 are depicted schematically, a counter-impression roller 3, provided with a drive, is positioned in the conventional manner. The side members 1, 2 carry a print unit bracket 4, on which the bearing blocks 5 and 6 of a printing roller 7 and an engraved roller 8 are moved in the direction of the double arrows A and B in guides that are not illustrated. The bearing blocks 5 and 6, mounted on both sides, can be moved by means of servomotors M1 to M4, which can be driven individually, and in particular in such a manner that each roller 7, 8 can be moved by itself alone and both of them can also be moved jointly in a fixed position relative to each other.

The printing machine frame 1, 2 is provided with additional ink system brackets (not illustrated), on which the printing and engraved rollers 8 can be moved in a suitable manner, thus providing only the single counter-impression roller 3 for all of the printing cylinders.

In principle the flexographic press of the invention can be equipped with respect to its mechanical design in the same way as the flexographic presses described in the DE 29 41 521 A1, DE 37 42 129 A1, and DE 40 01 735 A1.

The engraved roller 8 is provided with the conventional inking unit that comprises preferably a known ink fountain doctor.

The printing roller 7 is provided with blocks 9, printing on the paper web 17. In this case a rhombus pattern, which is shown in a simple manner in the figure, is printed. Owing to the printing roller 7, employed at the counter-impression roller 3, the paper web 17, running over the counter-impression roller 3 in the direction of the arrows C and D, is printed with a printed image 10, which is shown in the shape of rectangles for the sake of simplicity. This printed image 10 is shot in the scan range 11 by the camera K, which feeds the images shot in sequence by way of the line 12 to the control and regulating unit 13 provided with a computer. The data, relating to the diameter of the printing roller 7 and the thickness of the blocks 9 carried by the same, are entered into the control and regulating unit 13 by means of a special input device 14.

The desired contour of the printed image 10 to be printed is entered into the control and regulating unit 13 by means of another input unit 15, for example, in the form of data stored on a CD. Then, for example, in one embodiment the printed images shot by the camera K are compared with the desired contour of the printed image, entered by way of the input unit 15, in the control and regulating unit 13. The control and regulating unit 13 sends by means of lines the signals to an actuating device 16, which controls the servomotors M1 to M4 of the printing and engraved roller 7, 8 in accordance with the signals generated by the control and regulating unit 13.

As soon as the printing roller 7 has been moved by means of adjustments to a position that produces the qualitatively best printed images, the set values are deposited in a storage of the control and regulating unit so that the optimal setting of the printing and engraved rollers 7, 8 can be found again, if necessary.

Figure 2:
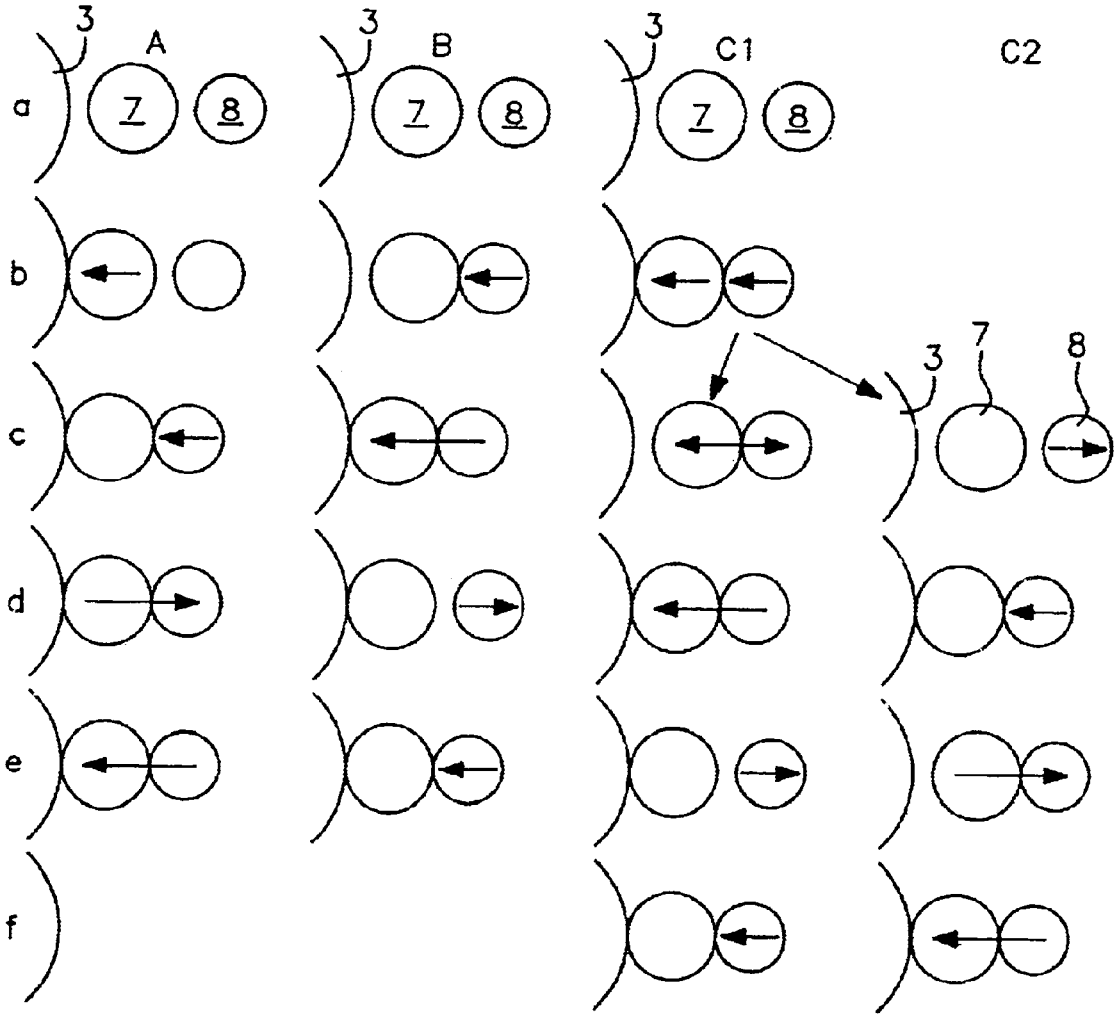

The embodiments depicted in FIG. 2 show in what manner or sequence the three involved rollers of a flexographic press can be set into head-on motion. In other printing processes, such as gravure printing, it is not necessary to show the setting of the relative roller position, since in gravure printing only two rollers are involved in the printing process.

FIG. 2 is constructed in matrix form. The columns marked with the upper case letters A to C contain the embodiments, whereas the lines marked with the lower case letters a to e contain the process steps of the individual embodiments. The material to be printed, which runs between the printing 7 and the counter-impression roller 6 during the printing process and which is assigned the reference numeral 17 in FIG. 1, is not shown in FIG. 2. The individual movement of the rollers 7, 8 is shown by means of an arrow inside a roller, whereas the arrow, which goes through both rollers, indicates the joint movement of the roller package without any change in the relative position of the rollers.

In particular the term "overprint" is often used in the description of FIG. 2. Therefore, it is pointed out at this point that "overprint" means setting the rollers into motion or pressing the rollers on, a feature that goes beyond the precise geometric dimensions of the same. This measure guarantees that between the "overprinted" rollers or between the material to be printed, which is printed between the overprinted rollers, and one of these rollers the ink is transferred over the whole area in each case. The "distance", over which one must "overprint", or the print, which is required to this end, varies hereby from printing process to printing process from fractions of a millimeter up to millimeters. It is clear that in most of the printing processes flexible rollers, material to be printed, or other flexible additional elements are used that increase this distance. Some examples are the blocks of the flexographic printing or the impression roller of gravure printing.

However, it is also worth mentioning that usually cylinders made of steel can also be overprinted with simple means by amounts that exceed the irregularity of their shell surface. This is especially the case when the cylinders have rubber-covered shell surfaces. For this reason the aforementioned overprinting can be used in different printing processes.

In the first embodiment A of FIG. 2, the line a—as in the other embodiments—is also the starting position, in which the three involved rollers 3, 7, 8 are not yet set into head-on motion toward each other.

In the process step A b the printing roller 7 is set into motion against the counter-impression roller 6 and overprints in the manner already described above. The individual motion of the printing roller 7 is shown by the arrow. In this manner it is guaranteed that all zones of the block (if they are inked) transfer the ink to the material to be printed. In the process step A b, however, no contact has been made yet; and thus no ink has been transferred to the printing roller 7 and the material to be printed.

The next process step c of the embodiment A consists of moving the engraved roller 8 up to the printing roller 7 until all of the image elements can be recognized on the material to be printed. This circumstance is verified with the aid of at least one camera using the method described above.

Since a permanent overprinting of the rollers 3 and 7 used in the process step b is undesired, the process steps A d and A e also take place at this stage.

The process step A d shows how the two rollers 7 and 8 are moved away from the counter-impression roller, whereby the adjusted relative position between the engraved roller 8 and the printing roller 7 is maintained.

In accordance with the process step A e the two rollers are moved up again to the counter-impression roller until all of the image elements are present once again on the material to be printed, a feature that is verified again with the aid of the camera. Thus, the process is terminated; the image to be printed is optimized; and the actual production process can start.

Even in the second embodiment B, the line a is the starting state, wherein the three involved rollers 3, 7, 8 have not been moved head-on toward each other.

In the process step B b the engraved roller 8 is set into motion toward the printing roller 7 and overprints in the manner already described above. In this way it is guaranteed that all of the zones of the block are totally covered with ink.

The next process step c of the embodiment B consists of moving the package comprising the engraved roller 8 and the printing roller 7 up to the counter-impression roller 3 until all of the image elements can be recognized on the material to be printed. This circumstance is verified with the aid of at least one camera by the method already described above.

Since a permanent overprinting of the rollers 7 and 8 used in the process step b is undesired, the process steps B d and B e also take place at this stage.

The process step B d shows how the roller 8 is moved away from the printing roller 7, whereby the adjusted relative position between the printing roller 7 and the counter-impression roller 3 is maintained.

In accordance with the process step B e the two rollers are moved up against each other until all of the image elements are present once again on the material to be printed, a feature that is verified again with the aid of the camera. Thus, the process is terminated; the image to be printed is optimized; and the actual production process can start.

In the third embodiment C the printing roller 7 and the engraved roller 8 are set into joint motion in the direction of the counter-impression roller 3, whereby all three involved rollers 3, 7, 8 are mutually overprinted.

In the embodiment C1, the pair of rollers, comprising the printing roller 7 and the engraved roller 8, is moved together away from the counter-impression roller, whereby the overprinting between the rollers of the pair of rollers is maintained.

In the process step C1 d the pair of rollers is set into motion in the direction of the counter-impression roller until all of the image elements are transferred to the material to be printed.

In the process step C1 e the engraved roller 8 is moved away from the printing roller. At a minimum there is no longer complete transfer of ink.

In process step C1 f the engraved roller 8 is moved again up to the printing roller 7 until the image to be printed is reproduced without any loss of area.

The distinction between the embodiment, according to FIG. 2C2, and the embodiment, according to FIG. 2C1, lies in the steps c to e. In step c the engraved roller 8 is moved out of its overprinted position relative to the printing roller in the direction of the arrow away from the printing roller, set into motion at the counter-impression roller 7 into the overprinted position. Finally the engraved roller 8 in step d is moved into its optimal position at the printing roller; in steps e and f the printing roller and the engraved roller are moved together away from the counter-impression roller. The control and regulating unit sets them into motion at the counter-impression roller in such a form that guarantees that the image to be printed is reproduced without any loss of area.

Figure 3:
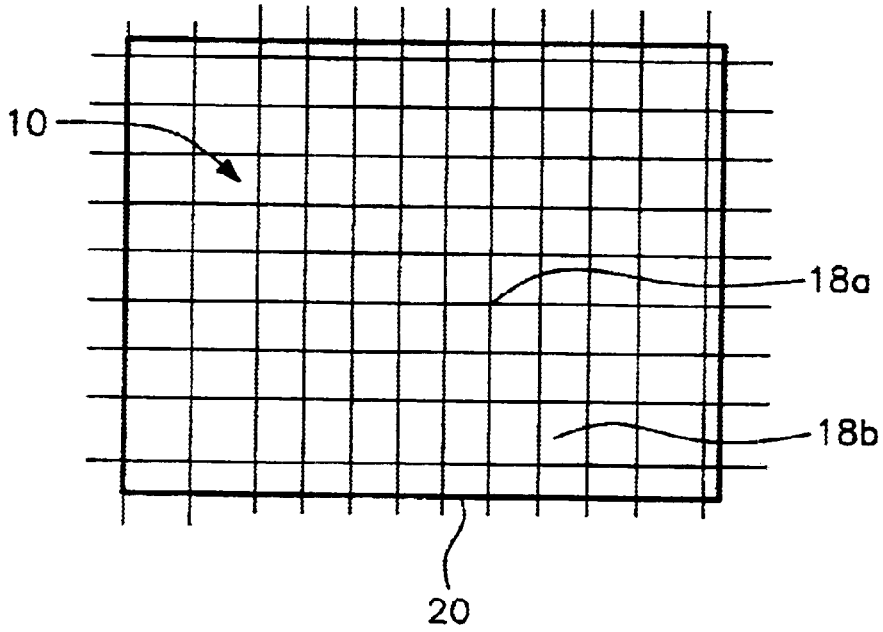
FIG. 3 is a schematic drawing of the division of the printed image into segments.

FIG. 3 is a schematic drawing of how the printed image 10, which is contained in the rectangle 20, can be sectioned into different segments 18. For reasons relating to the graph the image to be printed was not sketched in. In practice it is possible to section a printed image 10 into thousands of segments 18.

Figure 4:
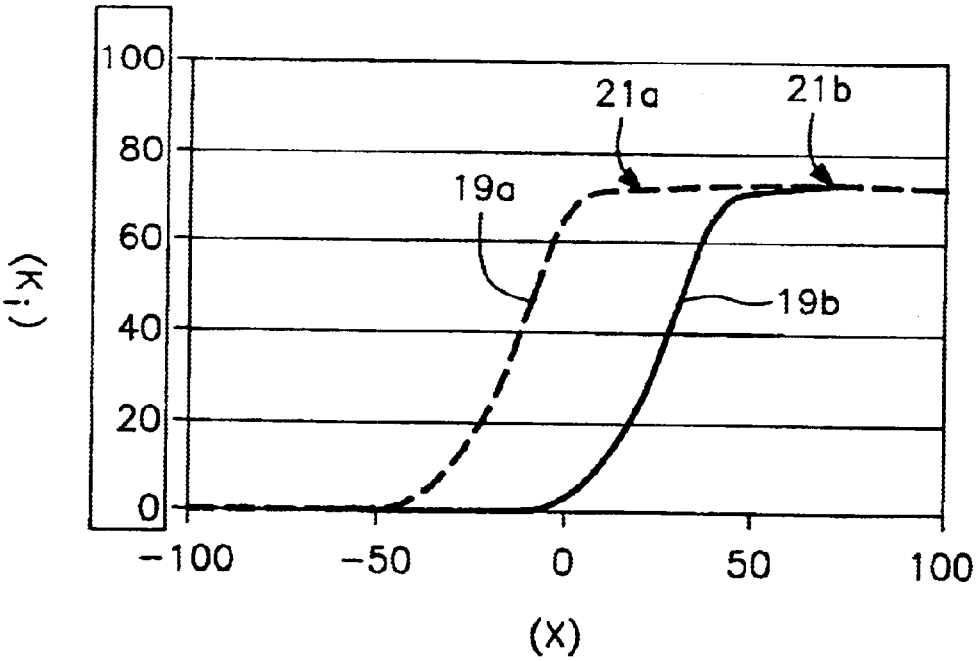
FIG. 4 is a schematic drawing of the curve of the contrast values of a printed image as a function of the relative roller position.

FIG. 4 shows the contrast curve $k_i$ of the segments 18*a* and 18*b*, which are plotted as the function of the position of the rollers x in relation to each other. The resulting characteristic lines 19*a* and 19*b* are assigned to the segments 18*a* and 18*b*. It becomes clear at once that both characteristic lines have largely the same shape. The circumstance that both characteristic lines exhibit almost identical maxima can be derived, however, from the fact that the contrast values in this embodiment were normalized. Such a normalization can be carried out, for example, with respect to the average values of several segments 18.

The curve of the two characteristic lines is offset in relation to the roller position, since the rollers involved in the printing process, blocks, etc. exhibit, as stated already several times, tolerances that in this case result in the segment 18*a* being completely printed "earlier" than the segment 18*b*. In the present embodiment the segment 18*a* is already completely printed, as soon as the area 21*a* of the characteristic line 19*a* has been reached. Both segments 19*a, b* are printed as soon as the segment 21*b* of the characteristic line 19*b* has been reached.

Analogously the additional setting process of the printing rollers can be terminated when the area 21*n* of an nth characteristic line is reached, where n is a selected number of image segments.

The circumstance that in the embodiment depicted the areas 21 of the characteristic lines 19 lie behind the second turning point of the characteristic lines 19 does not mean, however, that this must always be the case. Rather the reproduced characteristic lines exhibit several areas where the curve is so characteristic that an evaluator can recognize without any problems when the characteristic lines 19 of a selected number of image segments 18 has reached such an area. Thus, determining this area is a measure that depends on a number of parameters (image quality to be obtained, material to be printed, printing process, etc.) and can be done, as required.

A look at the characteristic lines of FIG. 4 makes it easier to understand that all of the inventive devices and processes function even when the rollers involved in the printing process are overprinted first and then the rollers are moved away from each other (yet the mechanical contact remains).

In this case the viewer would see the area of the characteristic lines that are shown on the right hand side in FIG. 4 and in which there is relative ink saturation on the printed material 17 and the slope of the characteristic lines is slight.

In this case the separating motion of the rollers has to be stopped when for a number m of segments 18, the assigned areas 21 of the characteristic lines 19 have been left, and the contrast values in these areas begin to decrease with greater rapidity.

Even this variant of the invention, wherein the roller positions are set by moving the rollers away from each other and this process is carried out until the printed image is reproduced without any undesired area loss, is covered by the main claim.

The arithmetical steps, required for the various mathematical operations to carry out the depicted embodiment, and the arithmetical steps to carry out the other embodiments included in the description and the claims can be done in an evaluating and computing unit. Said unit can also be contained in the control and regulating unit 13.

| List of Reference Numerals | |
|---|---|
| 1 | printing machine frame |
| 2 | printing machine frame |
| 3 | counter-impression roller |
| 4 | print unit bracket |
| 5 | bearing block |
| 6 | bearing block |
| 7 | printing roller |
| 8 | engraved roller |
| 9 | block |
| 10 | printed image |
| 11 | scan range |
| 12 | line |
| 13 | control and regulating unit |
| 14 | input device |
| 15 | input unit |
| 16 | setting device |
| 17 | paper web |
| 18 | segments of the printed image |
| 19 | contrast curve/characteristic line |
| 20 | rectangle |
| 21 | area of the characteristic line |
| K | camera |
| M1 | actuating drive |
| M2 | actuating drive |
| M3 | actuating drive |
| M4 | actuating drive |

What is claimed is:

1. Device and process for setting the printed image of a rotary press by adjusting the relative position of the rollers (3, 7, 8) involved in the ink transfer, whereby at least one part of these rollers (7, 8) can be moved toward each other both together and also independently of each other by means of their own actuating drives (M1 to M4), so that the rollers (3, 7, 8) involved in the printing process can be set into motion in relation to each other, characterized in that there is at least one camera (K) that scans the printed image (10) on the printed material web (17) and that feeds the images shot in succession to an electronic control and regulating unit (13), and that the control and regulating unit (13) generates signals for the actuating drives of at least one part of the rollers (3, 7, 8) involved in the printing and inking process until or as the printed image is reproduced without area loss.

2. Device and process, as claimed in claim 1, characterized in that there is a control program that knows the geometric dimensions of the rollers (3, 6, 7) involved in the printing and inking process, or the relative positions that can be derived from these dimensions, and which first adjusts tentatively the position of the rollers (3, 6, 7) in relation to each other by means of signals to the actuating drives, and that then the camera feeds the images shot in succession to an electronic control and regulating unit (13), and that finally the control and regulating unit produces signals for the actuating drives of at least one part of the rollers (3, 7, 8), involved in the printing and inking process, until or as the printed image (10) is reproduced without area loss.

3. Device and process, as claimed in claim 1, characterized in that a digitized desired contour of the printed image is deposited in a storage unit, that in a comparator of the control and regulating unit (13) the printed image that is shot is compared with a desired contour and that the control and regulating unit (13) generates signals for the actuating drives of the rollers involved in the printing or inking process until or as the comparison yields the best agreement between the printed image that is shot and the desired contour that is stored.

4. Device and process, as claimed in claim 1, characterized in that an evaluating or computing unit (13) sets in relation to the roller positions the intensity of the reflected light of different segments (18) of the printed image, whereby an intensity curve that is typical for the printing process can be observed for different segments of the printed image, and that the control and regulating unit (13) generates signals for the actuating drives (Ml, M2, M3, M4) of the rollers (3, 7, 8) involved in the printing or inking process until a predetermined portion of the different segments (18) of the printed image (10) exhibits or has exhibited a specific intensity curve (19).

5. Device and process, as claimed in claim 1, characterized in that the intensity of the reflected light of different segments (18) of the printed image (10) is subtracted from the intensity of the light reflected from the unprinted material to be printed (17); and that an evaluating and computing unit (13) sets differential or contrast values ($k_i$) of segments of the printed image in relation to the relative roller positions, whereby a similar intensity curve or contrast value curve (19) that is typical for the printing process can be observed for different segments of the printed image, and that the control and regulating unit (13) generates signals for the actuating drives (Ml, M2, M3, M4) of the rollers (3, 7, 8) involved in the printing or inking process until a predetermined portion of the different segments (18) of the printed image exhibits or has exhibited a specific intensity curve or contrast value curve (19).

6. Device and process, as claimed in claim 3, characterized by at least one color camera (K) to record the printed image (10) or at least parts of the same (10).

7. Device and process, as claimed in claim 6, characterized in that the light intensity curve or the curve of the contrast values of at least one color is set in relation to the roller position by a computer; and that the control and regulating unit (13) generates signals for the actuating drives (Ml, M2, M3, M4) of the rollers (3, 7, 8) involved in the printing or inking process until a predetermined portion of the different segments of the printed image (10) exhibits or has exhibited a specific color intensity curve (19).

8. Device and process, as claimed in claim 7, characterized in that the light intensity values or the contrast values (19) of several colors are plotted by the control and regulating unit; and that the computer transfers these values into another coordinate system based on coordinates derived from the light intensity values or contrast values (19); and that at least one selection of these coordinates is set in relation to the relative roller positions; and that the control and regulating unit (13) generates signals for the actuating drives (Ml, M2, M3, M4) of the rollers (3, 7, 8) involved in the printing or inking process until a predetermined portion of the different segments (18) of the printed image (10) exhibits or has exhibited a specific coordinate curve.

9. Device and process, as claimed in claim 4, characterized in that the values ($k_i$), derived from the light or color intensity of the reflected light of the printed image, are normalized.

10. Device and process, as claimed in claim 4, characterized in that the values ($k_i$) derived from the light or color intensity of the reflected light of the printed image are plotted in relation to the position of the rollers (3, 7, 8) involved in the printing or inking process and are rendered visible on a console or a screen.

11. Device and process, as claimed in claim 1, characterized in that in the case of several print units each print unit is set based on separate measurement processes.

12. Device and process, as claimed in claim 1, characterized in that several print units are set based on a measurement process.

13. Device and process, as claimed in claim 1, characterized by a separate setting of the actuating drives in order to make the rollers (3, 7, 8) involved in the printing process parallel.

14. Device and process, as claimed in claim 1, characterized in that the geometric settings of the rollers (3, 7, 8) in relation to each other, with which the best agreement between the printed image (10) that is shot and a desired contour of the printed image was determined and/or until a predetermined portion of the different segments (3, 7, 8) of the printed image exhibits or has exhibited a specific intensity or contrast curve, are deposited in a storage.

15. Process to adjust the printed image of a rotary press, as claimed in claim 1, characterized in that at least one overprint between at least two rollers (3, 7, 8) takes place during the additional setting process of the rollers (3, 7, 8) involved in the printing process.

16. Process to adjust the printed image of a rotary press, as claimed in claim 15, characterized in that the applied pressure prevailing between the rollers (3, 7, 8) involved in the overprinting decreases again; and the overprinting is terminated.

17. Process to adjust the printed image of a rotary press, as claimed in claim 16, characterized in that after the applied pressure was decreased, the rollers (3, 7, 8) are set into motion again in relation to each other, whereby the applied pressure increases again.

* * * * *